US008220613B2

(12) United States Patent
Dehne et al.

(10) Patent No.: US 8,220,613 B2
(45) Date of Patent: Jul. 17, 2012

(54) STACKABLE CARRIER ASSEMBLY, SYSTEM, AND METHOD FOR STORING CARRIER ASSEMBLIES

(75) Inventors: Noel F. Dehne, Novi, MI (US); Melvin A. Edwards, Livonia, MI (US); David M. Stewart, Waterford, MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 393 days.

(21) Appl. No.: 12/507,123

(22) Filed: Jul. 22, 2009

(65) Prior Publication Data

US 2011/0017572 A1 Jan. 27, 2011

(51) Int. Cl.
*B65G 15/64* (2006.01)
*B65D 21/036* (2006.01)

(52) U.S. Cl. ..... 198/346.2; 198/347.2; 198/735.6; 414/795.3; 290/33.998

(58) Field of Classification Search ..... 198/345.1, 198/347.2, 465.1, 735.2, 735.6; 104/127, 104/128, 171, 172.3, 48, 50; 414/794.9, 414/795.2, 795.3; 280/33.991, 33.998
See application file for complete search history.

(56) References Cited

U.S. PATENT DOCUMENTS 3,160,292 A * 12/1964 Albrecht ..... 414/788.2
3,522,954 A 8/1970 Locke
3,757,967 A * 9/1973 Colbridge ..... 414/286
3,827,365 A * 8/1974 Coppel ..... 104/88.03
3,945,510 A * 3/1976 Saul et al. ..... 414/286
4,440,090 A * 4/1984 Murai et al. ..... 104/127
4,611,962 A 9/1986 Braly et al.
4,616,570 A * 10/1986 Dehne ..... 104/172.3
4,629,383 A * 12/1986 Buss ..... 211/121
4,917,557 A 4/1990 Kato et al.
4,939,999 A 7/1990 Burt et al.
4,987,834 A * 1/1991 Peck et al. ..... 104/300
5,137,159 A * 8/1992 Collins et al. ..... 211/151
5,355,579 A * 10/1994 Miyasaka et al. ..... 29/712
5,374,155 A 12/1994 Van Baale et al.
5,511,757 A * 4/1996 Freelander ..... 248/346.03
5,785,328 A 7/1998 Eckloff
5,833,427 A * 11/1998 Siegler et al. ..... 414/277
5,852,979 A * 12/1998 Desilets et al. ..... 104/172.4
5,890,855 A 4/1999 Claps
6,079,720 A * 6/2000 Spear et al. ..... 280/47.371
6,220,953 B1 4/2001 Cornelissen et al.
6,257,152 B1 * 7/2001 Liu ..... 108/53.3
6,374,747 B1 4/2002 Devnani et al.
6,494,304 B1 12/2002 Jaynes et al.
6,513,442 B1 2/2003 Miller et al.
6,543,795 B1 * 4/2003 Merced Ferrer ..... 280/33.998
6,966,427 B2 * 11/2005 Kilibarda ..... 198/465.4
6,997,303 B2 * 2/2006 Edwards et al. ..... 198/345.2

(Continued)

*Primary Examiner* — Douglas Hess
(74) *Attorney, Agent, or Firm* — Dickinson Wright PLLC

(57) ABSTRACT

A stackable carrier assembly, carrier stacking system, and method of storing carrier assemblies is disclosed. The carrier assembly includes a base member presenting a load surface and opposite facing transfer surface. A plurality of carrier trolleys extend transversely from the load surface to engage conveyor tracks. A plurality of track sections are coupled to the load surface for receiving the carrier trolleys of another carrier assembly. The track sections are vertically aligned with the carrier trolleys. In a power and free or friction drive conveyor system, a lift device and telescoping arm can lift and stack the carrier assemblies so that track sections of one carrier assembly receive the carrier trolleys of another carrier assembly. In an overhead conveyor system, one carrier assembly can hang from the track sections of another carrier assembly.

26 Claims, 8 Drawing Sheets

U.S. PATENT DOCUMENTS 7,125,215 B2 * 10/2006 Kinzer ..... 414/272
7,153,078 B2 12/2006 Beerhalter et al.
7,232,027 B2 * 6/2007 Kilibarda ..... 198/465.4
7,686,156 B2 * 3/2010 Tabler ..... 198/465.4
7,806,643 B2 * 10/2010 Friedman et al. ..... 414/222.01

* cited by examiner

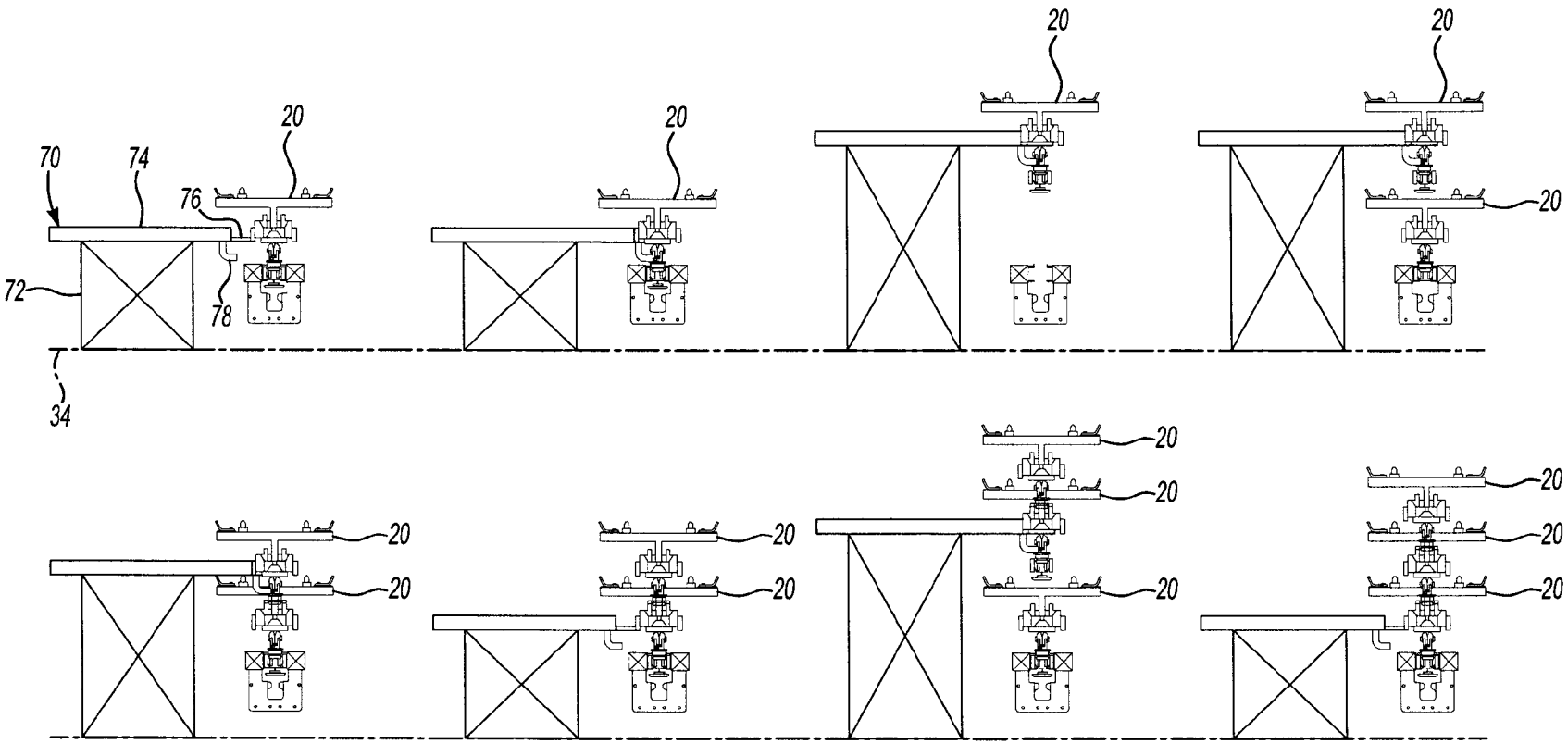
20
20
20

STACKABLE CARRIER ASSEMBLY, SYSTEM, AND METHOD FOR STORING CARRIER ASSEMBLIES

BACKGROUND OF THE INVENTION

1. Field of the Invention

The present invention generally relates to the storage of carriers used to transport workpieces, and more particularly, to carriers used in conveyor systems.

2. Description of the Prior Art

Carriers are widely used to move workpieces of various shapes and sizes, such as vehicle bodies, throughout manufacturing and storage facilities. The carriers typically include a base member presenting a load surface for holding the workpieces and an oppositely facing transport surface with a plurality of trolley wheels coupled thereto.

Conveyor systems are often used to transport the carriers through the manufacturing or storage area. The conveyor system can include a power and free (PF) system, an overhead PF system, a friction drive system (FDS), an overhead FDS, an electrified monorail system (EMS), an overhead EMS, etc. The PF conveyor system typically includes a power chain moveable within a conveyor track driving the carrier. The friction drive conveyor system typically includes a conveyor track supporting the trolley wheels. The friction drive conveyor system also includes friction drive wheels adjacent the conveyor track for urging the carriers along the conveyor track. Each type of conveyor system quickly and reliably transports workpieces at various speeds through various track configurations of the manufacturing or storage areas.

After the workpieces are transported through the manufacturing area and unloaded from the carriers, the empty carriers are typically stored for future use. Existing carriers cannot be stacked on top of one another, like skids, due to the multiple load bars and trolley wheels. While in storage, the empty carriers are typically stored in idle rows of the conveyor tracks, as shown in FIG. 18, or in rows on the floor of a storage area. The empty carriers extend over large areas, which limit the available floor space for other manufacturing operations. Oftentimes, a manufacturing facility lacks the floor space required to store all the empty carriers used in the conveyor systems. Thus, manufacturers must obtain additional storage space and incur the associated costs.

SUMMARY OF THE INVENTION AND ADVANTAGES

In view of the above, the need exists to efficiently store carriers including multiple carrier trolleys. The present invention is directed to a stackable carrier assembly, a carrier stacking system, and a method of storing carrier assemblies. The carrier assembly includes a base member presenting a load surface and a transport surface. A plurality of carrier trolleys are coupled to the transport surface, and a plurality of track sections are coupled to the load surface. A plurality of the carrier assemblies can be stacked one on top of the other by lifting a first carrier and engaging the carrier trolleys of the first carrier with the track sections of a second carrier.

The carrier stacking system includes a conveyor system for conveying the plurality of carrier assemblies through a predetermined area. The conveyor system includes a conveyor track for engaging the carrier assemblies, and a lift means for lifting and lowering the carrier assemblies to and from the conveyor track.

As shown in FIG. 16, by stacking multiple carriers on top of one another, the area required for storing the empty carrier assemblies is greatly reduced. The area saved by stacking the carrier assemblies provides floor space for other manufacturing operations. Further, manufacturing facilities can be designed to include the carrier stacking system to save space and thus reduce real estate costs.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 17 illustrates an exemplary embodiment of the method of the present invention.

DETAILED DESCRIPTION OF THE INVENTION

A stackable carrier assembly 20, carrier stacking system, and method of storing carrier assemblies 20 is illustrated and described with reference to the figures. It should be appreciated that the stackable carrier assembly 20 can be used in a variety of applications beyond the illustrated applications.

Figure 1:
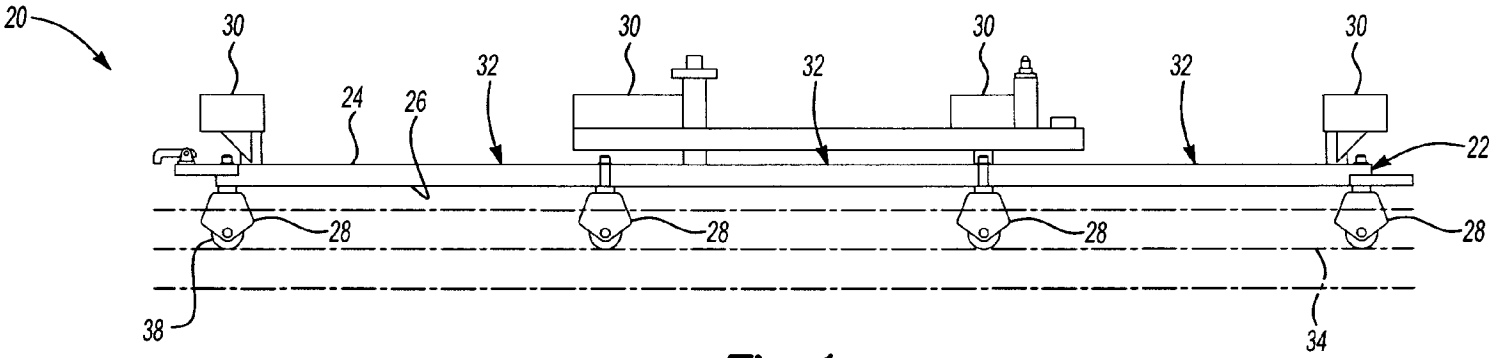
FIG. 1 is a side view of a carrier assembly.
Figure 2:
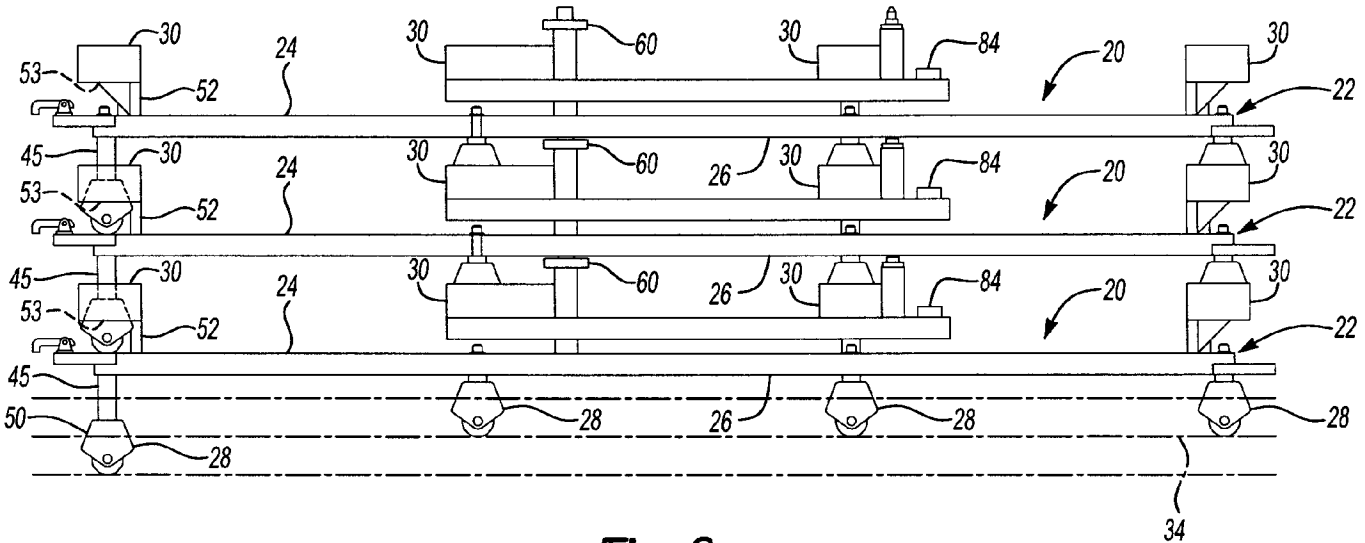
FIG. 2 is a side view of stacked carrier assemblies including pedestals coupling track sections to a load surface.
Figure 3:
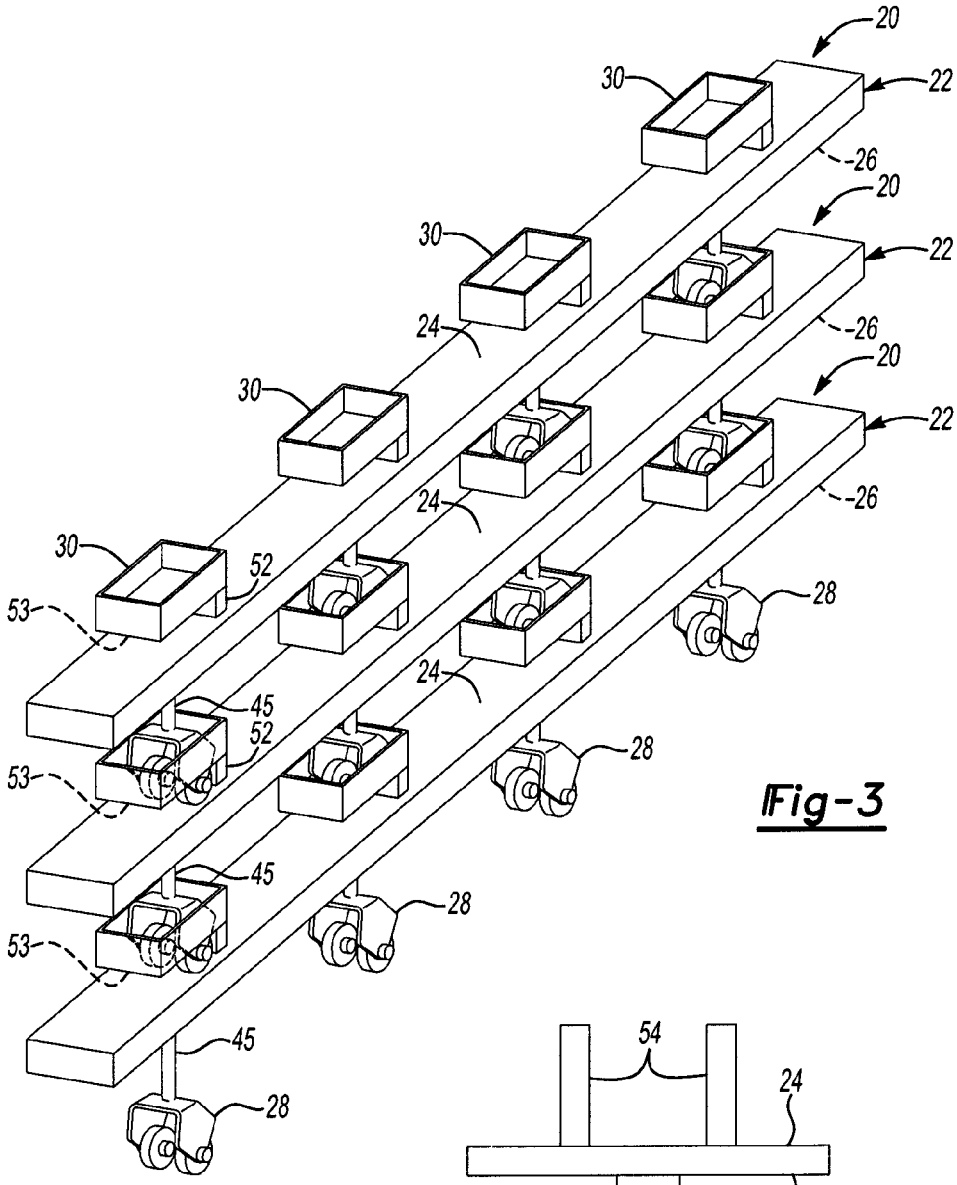
FIG. 3 is a perspective view of the stacked carrier assemblies shown in FIG. 2.
Figure 4:
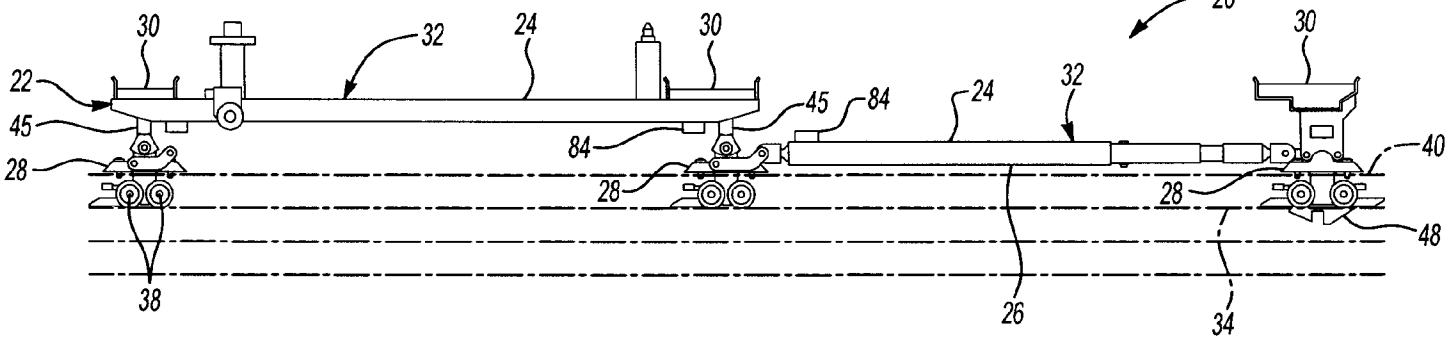
FIG. 4 is a side view the carrier assembly including elongated carrier trolley stands and non-planar load surfaces.
Figure 5:
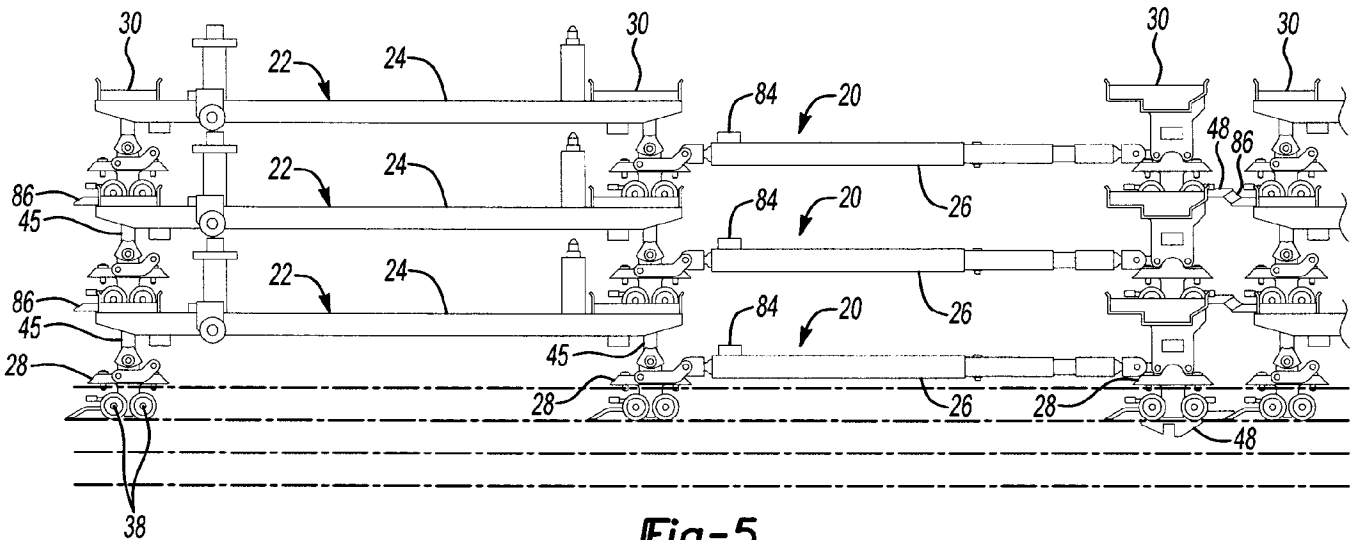
FIG. 5 is a side view of the stacked carrier assemblies including the elongated carrier trolley stands and the non-planar load surfaces.

The stackable carrier assembly 20 includes a base member 22 presenting a load surface 24 and a transport surface 26. A plurality of carrier trolleys 28 are coupled to the transport surface 26 and a plurality of track sections 30 are coupled to the load surface 24, as shown in FIGS. 1 and 4. The track sections 30 allow the carrier assembly 20 to be stacked on another one of the carrier assemblies 20, as shown in FIGS. 2, 3, and 5. The base member 22 can include a single load bar 32 having a rectangular-shaped cross section presenting the load surface 24 and transport surface 26. The base member 22 can also include a plurality of structures, each presenting the load surface 24 and transport surface 26, such as a plurality of the load bars 32 each extending in end-to-end relationship, as shown in FIG. 1. Alternatively, the base member 22 can include a pallet, elongated frame, beam, or any number of other structures.

Figure 7:
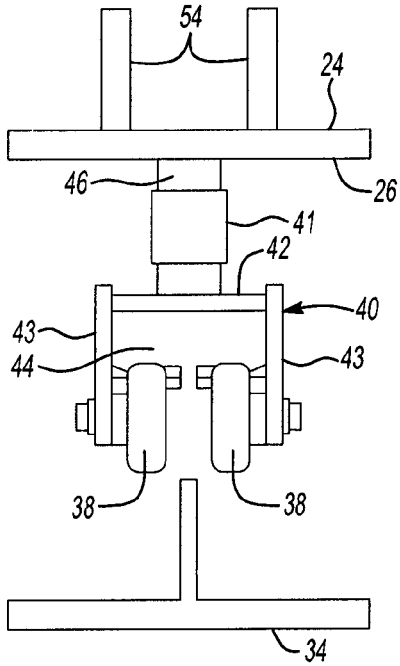
FIG. 7 is an end view of a carrier trolley of the carrier assembly.
Figure 12:
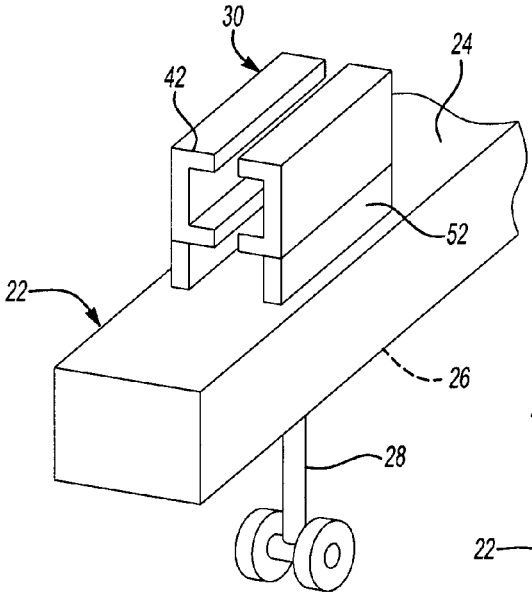
FIG. 12 is a perspective view of the track section including elevated C-shaped channels.

The carrier trolleys 28 extend transversely from the transport surface 26 of the base member 22 to engage a conveyor track 34 of a conveyor system. Each of the carrier trolleys 28 typically includes at least one wheel 38, but preferably a pair of wheels 38 spaced and parallel to one another and interconnected by a stand 40, as shown in FIG. 7. The carrier trolleys 28 can alternatively include two pairs of wheels 38, as shown in FIGS. 4 and 5. The stand 40 can include a rod 41 extending downwardly from the transport surface 26. The rod 41 can be coupled to a top plate 42 extending parallel to the transport surface 26 and across the wheels 38. A pair of supporting gussets 43 or side flanges can extend downwardly from the top plate 42 and bolted to the wheels 38. The top plate 42 and wheels 38 define an open space 44 for receiving a portion of the conveyor track 34, which will be discussed further. Alternatively, the wheels 38 of the carrier trolley 28 can be connected by an axle extending through the center axis of each wheel 38, as shown in FIG. 12, to accommodate track sections 30 having certain designs, which will be discussed further below. The rod 41 of the carrier trolleys 28 can extend from the transport surface 26 to the axle, as shown in FIG. 12.

As shown in FIG. 4, one or more of the load bars 32 can be disposed on elongated carrier trolley stands 45 so that the load surfaces 24 are disposed in a non-planar relationship to one another. The elongated carrier trolley stands 45 have a greater length than the other carrier trolley stands 40 of the carrier assembly 20. In the embodiment shown in FIG. 4, the carrier assembly 20 includes two load bars 32 with the first load bars 32 supported at each end by the elongated carrier trolley stand 40. The second load bar 32 is support at one end by a standard carrier trolley stand 40. The end adjacent the first load bar 32 is coupled to the elongated carrier trolley stand 45 at a height equal to the other carrier trolley stand 40 so that the second load bar 32 extends parallel to the conveyor track 34 and non-planar relative to the first load bar 32. The carrier assemblies 20 including the elongated carrier trolley stands 45 and non-planar load bars 32 can also be stacked on one another, as shown in FIG. 5.

The carrier assembly 20 can also include a pivotal connection 46 between each of the carrier trolleys 28 and the base member 22 to allow rotational movement of the base member 22 relative to the carrier trolleys 28 and to facilitate movement of the carrier assembly 20 along vertical curves. The pivotal connection 46 is typically part of or coupled to the carrier trolley stand 40, such as the rod 41 shown in FIG. 7. Alternatively, the carrier trolleys 28 can be connected to the base member 22 so as to prevent pivotal movement. The carrier trolleys 28 can include other elements known in the art.

The carrier trolleys 28 are typically spaced equal distances from one another along the transport surface 26 between the ends of the carrier assembly 20, as shown in FIG. 1. Alternatively, the carrier trolleys 28 can be spaced unequal distances from one another, so that the high load areas of the carrier assembly 20 include more carrier trolleys 28 for support. For carrier assemblies 20 including multiple load bars 32, the carrier trolleys 28 can be coupled to each load bar 32, or fewer than all of the load bars 32. The carrier trolleys 28 can also span the end-to-end relationship between the load bars 32, as shown in FIG. 1. The carrier assembly 20 can include various types of carrier trolleys 28, including drive carrier trolleys 28, load carrier trolleys 28, and accumulating carrier trolleys 28. For carriers used in Power and Free (PF) conveyor systems, the carrier assembly 20 can include a drive carrier trolley 28 including an elongated trolley stand 45 and extending a greater distance from the transport surface 26 than the load carrier trolleys 28, as shown in FIG. 5. The drive carrier trolley 28 in the PF conveyor system can alternatively include two pairs of wheels and the standard trolley stand 40, as shown in FIGS. 4 and 5. The drive carrier trolley 28 is preferably a DOG MAGIC® trolley 28 such as that manufactured by Jervis B. Webb Company, and includes a retractable dog 48, as shown in FIGS. 4 and 5, for selectively engaging the conveyor track 34. The carrier assembly 20 can also include other types of carrier trolleys 28 having various designs and locations relative to the base member 22.

As stated above, track sections 30 of the carrier assembly 20 are coupled to the load surface 24. The track sections 30 can be coupled to the load surface 24 presented by the load bars 32, as shown in FIG. 1, or to the load surface 24 presented by other structures of the base member 22, such as the pallet, beam, or frame. Preferably, each track section 30 of the carrier assembly 20 is vertically aligned above one of the carrier trolleys 28, as shown in FIG. 1, to provide for stable stacking of the carrier trolleys 28 of another carrier on top of the track sections 30, which will be discussed further below. Each of the carriers can include four carrier trolleys 28 and track sections 30, as shown in FIG. 1, or other numbers of carrier trolleys 28 and track sections 30, depending on the length and load requirements of the carrier assembly 20.

For carrier assemblies 20 used in PF conveyor systems including the drive carrier trolley 28 having the elongated carrier trolley stand 45 extending the greater distance from the transport surface 26 than the load carrier trolleys 28, the carrier assemblies 20 can include pedestals 52 to elevate the track sections 30 above the load surface 24 and connect the track sections 30 to the load surface 24, as shown in FIGS. 2 and 3. The elevated track sections 30 can receive the load carrier trolleys 28, and one of those elevated track sections 30 can include an open bottom 53 for receiving the drive carrier trolley 28. The drive carrier trolley 28 extends through the open bottom 53 and rests directly on the load surface 24. The pedestal 52 can be adjusted to various heights relative to the load surface 24 to accommodate drive carrier trolleys 28 of various lengths.

Figure 9:
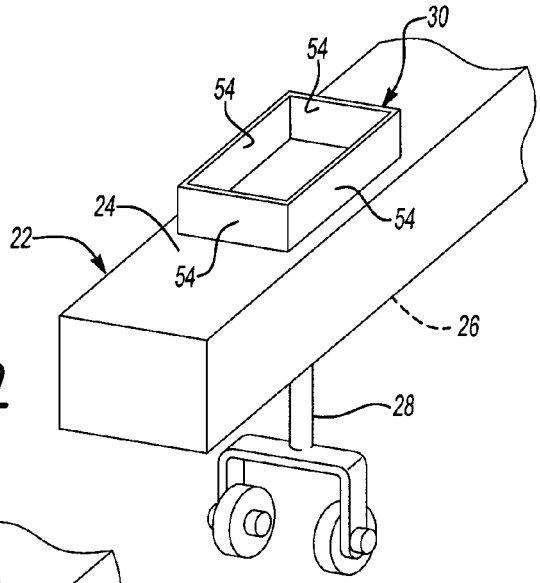
FIG. 9 is a perspective view of the track section defining an open container.

Each of the track sections 30 can be defined by one or more plates 54 extending upwardly from and perpendicular to the load surface 24, as shown in FIG. 7. For example, each track section 30 can include a plurality of the plates 54 defining an open container for receiving the carrier trolleys 28 of another carrier. As shown in FIG. 9, four plates 54 can be connected to form an open rectangular box.

Figure 10:
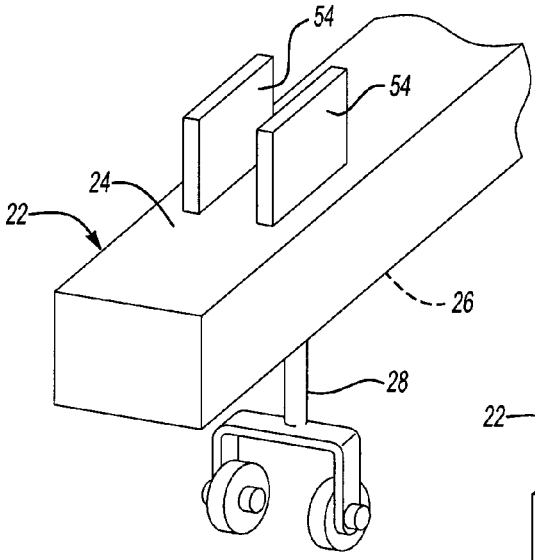
FIG. 10 is a perspective view of the track section including a U-shaped channel.
Figure 11:
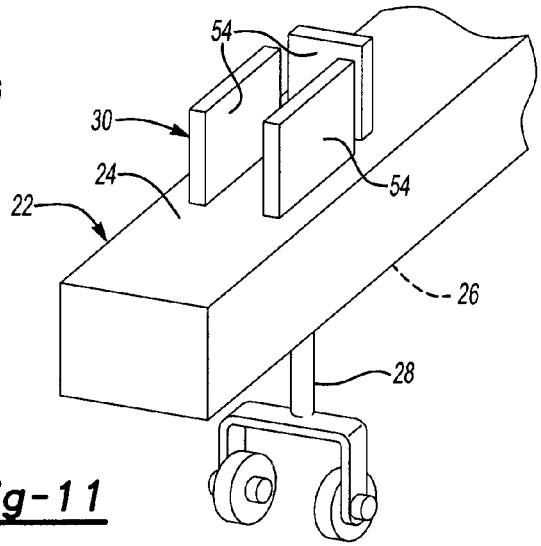
FIG. 11 is a perspective view of the track section including the U-shaped channel and a second plate.

Each of the track sections 30 can also include a first pair of the plates 54 disposed in generally parallel relationship to one another to define a U-shaped channel along the load surface 24 for receiving the carrier trolleys 28 of another carrier, as shown in FIG. 10. The U-shaped channel typically extends parallel to the sides of the base member 22. For carriers including the U-shaped channels, at least one of the track sections 30 can include a second plate 54 or pair of second plates 54 extending transverse to and across the U-shaped channel to close the open ends of the U-shaped channel, as shown in FIG. 11. The second plates 54 can secure one of the carrier trolleys 28 of another carrier in the track section 30. The track sections 30 including the U-shaped channel can also be elevated and include an open bottom to accommodate the drive carrier trolleys 28 used in the PF conveyor system.

The track sections 30 can also include a pair of C-shaped channels each having an upper flange 42 and a lower flange 42 projecting toward and spaced from one another, as shown in FIG. 12. The lower flange 42 of the C-shaped channel can be disposed along the load surface 24. The track sections 30 including the C-shaped channels having a cross-sectional shape similar to conveyor tracks 34 commonly used in PF conveyor systems. Like the U-shaped channels, at least one of the C-shaped channels can include a second pair of plates 54 to close the open ends of the C-shaped channel. The C-shape channels can also be coupled to the load surface 24 by a pedestal 52 so the open bottom of the C-shaped channel are spaced from the load surface 24, as shown in FIG. 12, for accommodating the drive carrier trolleys 28 of the PF system. The carrier trolleys 28 can include the axle connecting the two wheels 38 so that the carrier trolleys 28 of another carrier assembly 20 of the same type can roll into the C-shaped channels. The load carrier trolleys 28 of the other carrier assembly 20 engage the elevated track sections 30 while the drive carrier trolley 28 of the other carrier assembly 20 rolls along and rests on the load surface 24.

Figure 13:
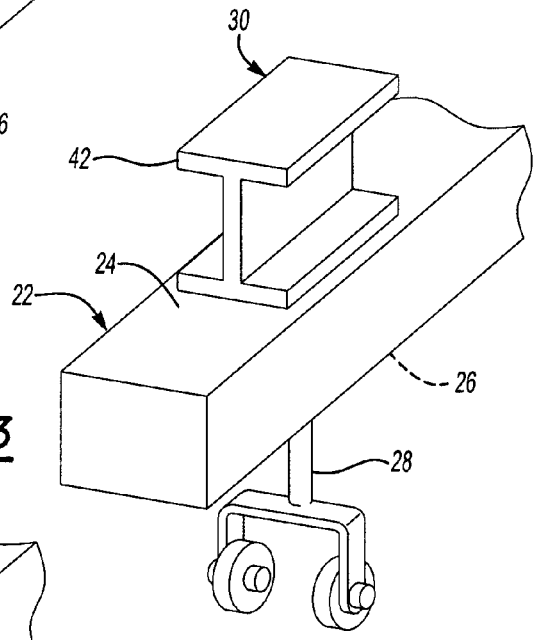
FIG. 13 is a perspective view of the track section including an I-shape cross section.

The track section 30 can also each include an I-beam portion, as shown in FIG. 13, having an I-shaped cross section similar to conveyor tracks 34 used in friction drive conveyor systems. The carrier trolleys 28 of another carrier assembly 20 can be placed on the load surface 24 adjacent the track section 30 and then rolled into the track section 30 so that the top flange 42 of the I-beam is disposed in the open space 44 of the carrier trolley stand 40 of the other carrier assembly 20. The I-beam portion can be formed as a single unit, or by a plurality of plates 54 welded together.

Figure 6:
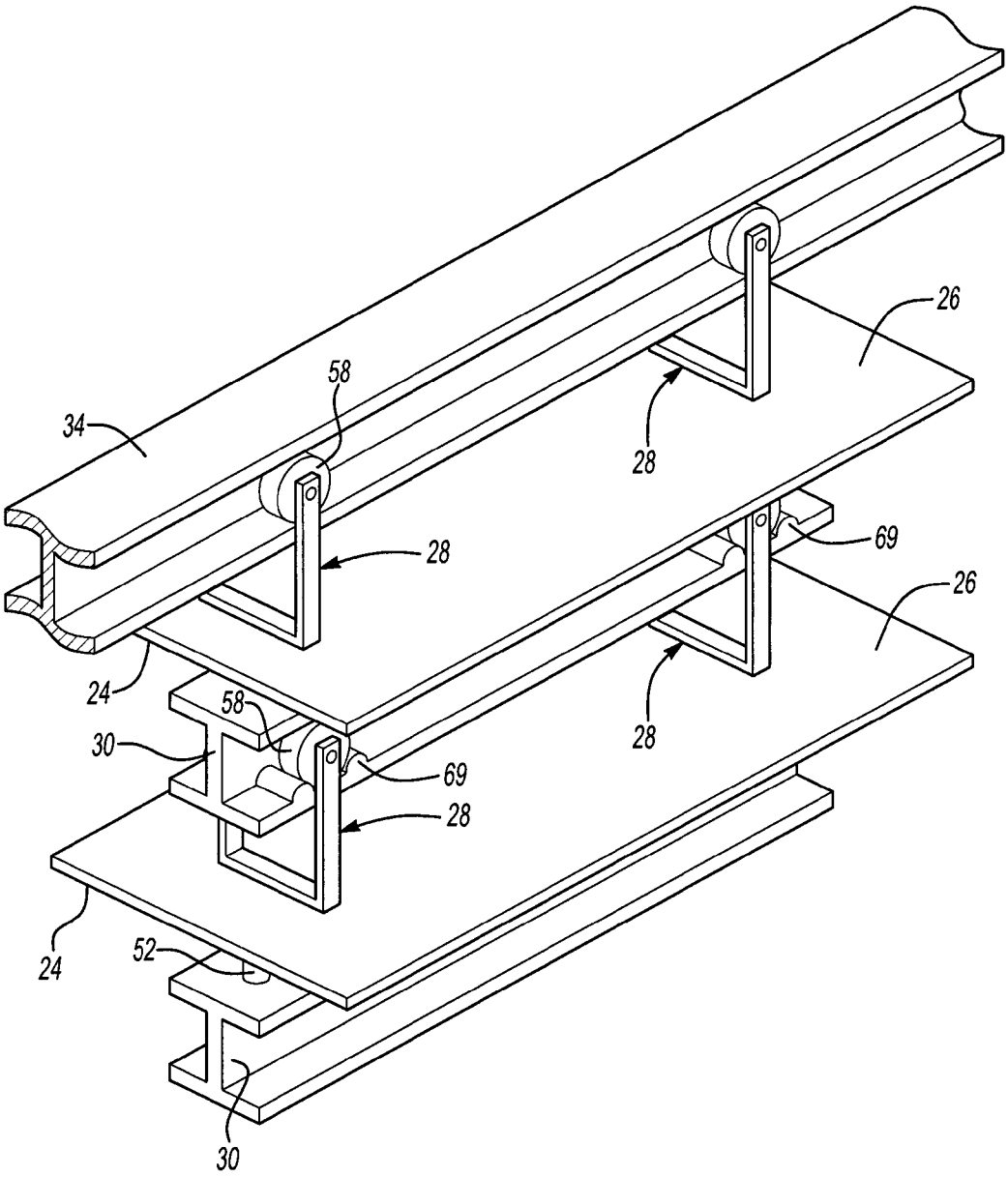
FIG. 6 is a perspective view of the stacked carrier assemblies of an overhead conveyor system.
Figure 8:
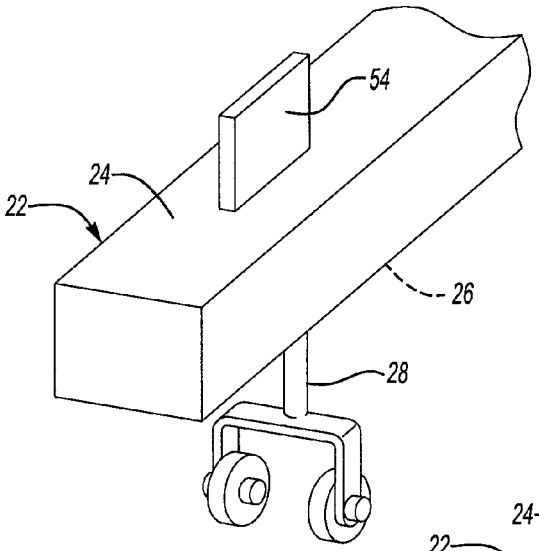
FIG. 8 is a perspective view of a track section including a plate.

In the overhead conveyor system, the track section 30 can include an I-shaped load bar, as shown in FIG. 6. The I-shaped load bar can be coupled to the load surface 24 by at least one pedestal 52. The carrier trolleys 28 of another carrier assembly 20 can roll along the I-shaped load bar so that the base member 22 of the other carrier assembly 20 hangs below the I-shaped load bar, as shown in FIG. 6. The I-shaped load bar includes a lower flange having at least one opening allowing carrier trolleys 28 of another carrier assembly 20 to enter the track section 30. The I-shaped load bar also includes a plurality of ribs defining pockets 69 each aligned above one of the carrier trolleys 28, as shown in FIG. 6. The pockets 69 can maintain or trap the wheels 58 of another carrier assembly 20 in place on the track section 30 and prevent the carrier trolleys 28 from rolling off the track section 30.

Figure 14:
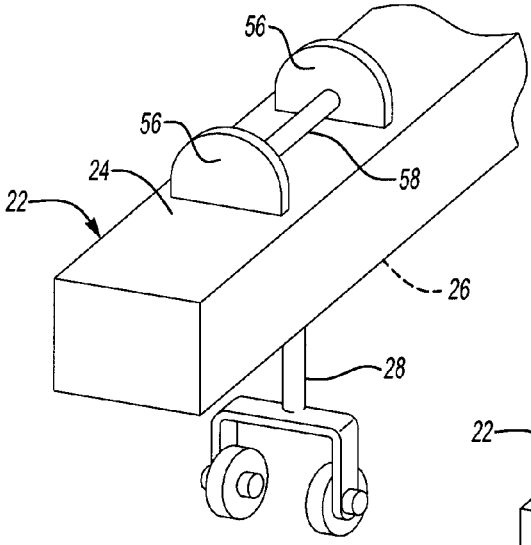
FIG. 14 is a perspective view of the track section including gussets and a perch.
Figure 15:
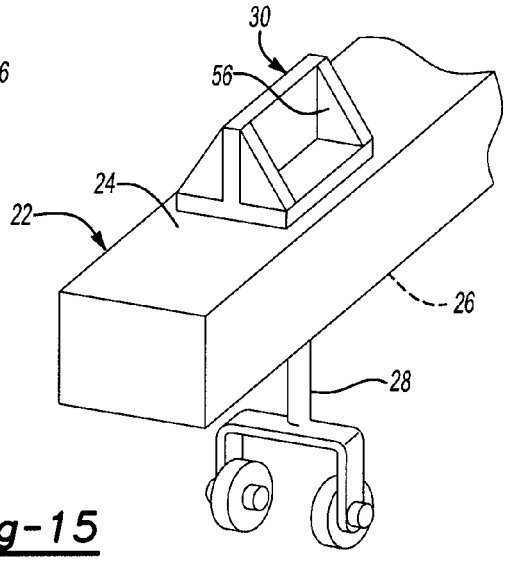
FIG. 15 is a perspective view of the track section including a T-shaped cross section and gussets.

Another alternate design of the track section 30 can include a pair of gussets 56 spaced and parallel to one another. The gussets 56 can be interconnected by a perch 58, as shown in FIG. 14. The perch 58 can be spaced from the load surface 24 and have a cylindrical or rectangular shape. Alternatively, each of the track sections 30 including a pair of the plates 54 disposed transverse to one another to present a T-shaped cross section. The top of the T-shape can be disposed along the load surface 24 and the stem of the T-shape can extend upward from the load surface 24. A gusset 56 can be disposed on each side of the stem at both ends of the track section 30, as shown in FIG. 15, to prevent movement of the carrier trolleys 28 of another carrier assembly 20 disposed on the track section 30.

The plates 54, gussets 56, I-beams, and other structures used to form the track sections 30 are typically formed from a metal material, such as aluminum or steel, but can include other materials. The track sections 30 are typically welded to the load surface 24 or secured by a bolt, screw, or other mechanical connector. The track sections 30 of each carrier are typically identical to one another, but can be different from one another. Although not shown, the track members can include a variety of other designs capable of receiving the carrier trolleys 28 of another carrier assembly 20. As shown in FIGS. 4 and 5, the track sections 30 can be designed to receive the retractable dog 48 of the drive trolley 28 and include a front perch with a pad to hold the retractable dog 48 in up position, as shown in FIG. 5, to allow for banking of the carrier assemblies 22. Also, the track sections 30 can be formed integral with the load surface 24 of the base member 22, including, but not limited to, a cast base member 22 having the track sections 30.

Typically, the track sections 30 are equally spaced from one another along the base member 22 and aligned with the carrier trolleys 28. However, the track sections 30 can be spaced from one another by unequal distances, and can be connected to one another to form a continuous track along the load surface 24. As shown in FIG. 3, each of the track sections 30 typically span a three dimensional area approximately equal to the three dimensional area spanned by one of the carrier trolleys 28 so that the track sections 30 can receive and maintain the carrier trolleys 28 in a stable position while allowing rotational movement of the carrier trolleys 28 relative to the track sections 30.

Each carrier assembly 20 can also include a securing means 60 for securing the carrier assembly 20 to another carrier assembly 20, so that the stacked carrier assemblies 20 remain in position when lifted, moved or conveyed along the conveyor track 34. The securing means 60 can include a mechanical lock attached to a support bar, as shown in FIG. 2, or other device. However, the securing means 60 can be the track sections 30 alone. In other words, the engagement of the carrier trolleys 28 and the track section 30 can securely hold the stacked carrier assemblies 20 in position. The carrier assembly 20 can include other elements known in the art, including stabilizer wheels coupled to the transport surface 26 or support bars extending upwardly from the load surface 24 to hold a workpiece or support another carrier assembly 20 stacked thereon. The carrier assembly 20 can include fork pockets 84 extending from the base member 22 to assist with lifting the carrier assembly 20, as shown in FIGS. 4 and 5.

As alluded to above, the carrier assembly 20 can be a range of different shapes and sizes for conveying and accommodating workpieces and other materials of various sizes. For carrier assemblies 20 used in PF conveyor systems, the front of the retractable dog 48 can engaged or be attached to a rear cam 86 of another one of the carrier assemblies 20 allowing a plurality of the carrier assemblies 20 to be connected in end-to-end relationship. As shown in FIG. 5, the front of the retractable dog 48 can extend through the front of the track section 30 and past the front of the carrier assembly 20 and attach to the rear cam 86 of the adjacent carrier assembly 20. The retractable dog 48 is in the up position so that the carrier assemblies 20 can bank without jamming. Although not shown, carrier assemblies 20 can include other elements instead of, or in addition to the rear cam 86 and retractable dog 48 allowing for carrier assembly 20 accumulation.

Figure 16:
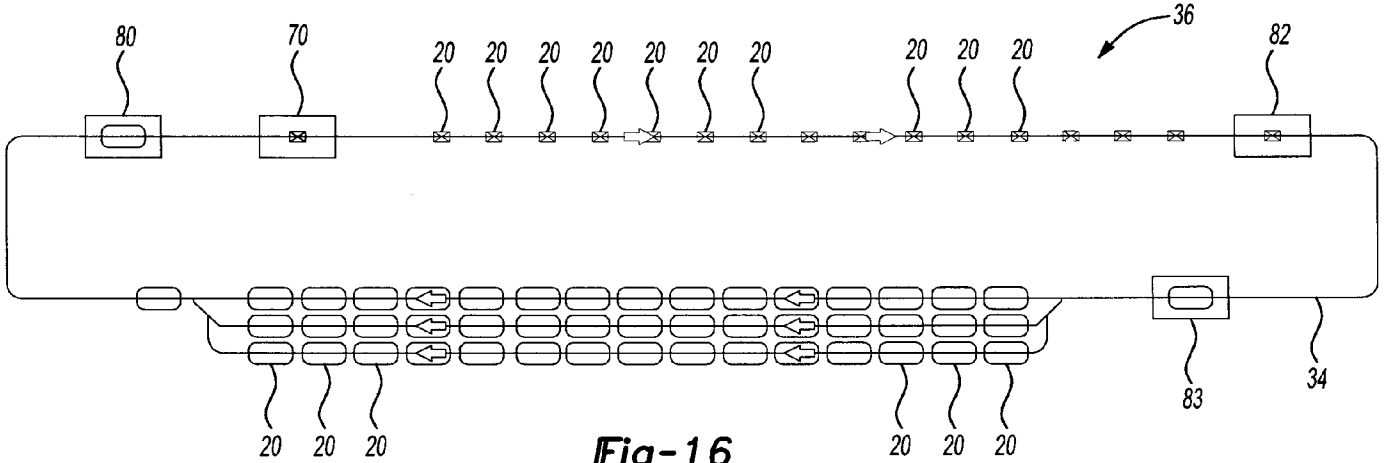
FIG. 16 is a plan view of a carrier stacking system.
Figure 18:
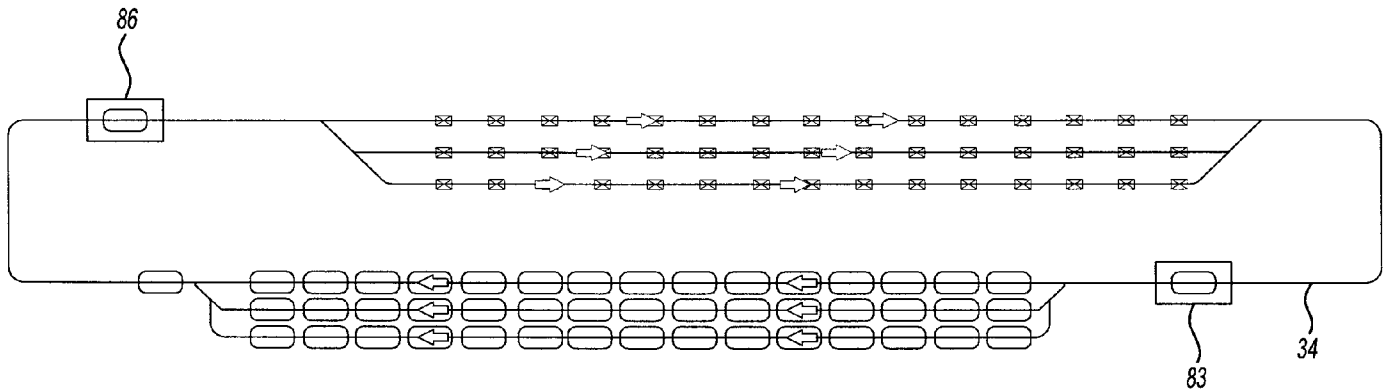
FIG. 18 is a plan view of the prior art.

The carrier assembly 20 is used in the carrier stacking system, as shown in FIG. 16. The carrier stacking system is typically used in a manufacturing or storage area, wherein carrier assemblies 20 are used to convey numerous workpieces over large areas. The carrier stacking system includes a plurality of the carrier assemblies 20 each presenting the load surface 24 and the transport surface 26. Each of the carrier assemblies 20 includes a plurality of the carrier trolleys 28 extending transversely from the transport surface 26, as described above. Each of the carrier assemblies 20 also includes a plurality of the track sections 30 coupled to the load surface 24 for engaging the carrier trolleys 28 of another one of the carrier assemblies 20, as described above.

The carrier stacking system 36 includes the conveyor system for conveying the plurality of carrier assemblies 20 through a predetermined area, such as the manufacturing area. The carrier assemblies 20 can be spaced from one another or disposed in abutting engagement as they are conveyed along the conveyor system. As showing in FIG. 16, the conveyor system includes a conveyor track 34 for driveably engaging the carrier trolleys 28 of the carrier assemblies 20. The conveyor system can include a power and free (PF) conveyor system, a friction drive conveyor system, an overhead conveyor system, or another type of conveyor system.

The PF conveyor system can be configured in a manner known in the art, such as is described in U.S. Pat. No. 4,616,570, titled "Power And Free Conveyor System." The conveyor track 34 of the conveyor system can include a power track for driveably engaging the drive carrier trolley 28 of the carrier assembly 20 and a free track for driveably engaging the load carrier trolleys 28 and other carrier trolleys 28. The free track can be disposed vertically above the power track and the two tracks are interconnected by a web. As alluded to above, each of the conveyor tracks 34 can include a pair of C-shaped channels each having a lower flange projecting from one of the vertical portions of the web toward one another to engage and support the carrier trolleys 28. The power track of the PF conveyor system typically includes a power chain moveable within the C-shaped channel for driving the carrier trolleys 28. As stated above, the drive carrier trolley 28 is preferably a DOG MAGIC® trolley 28 including a retractable dog 48. Pusher dogs are fixed to the power chain and extend vertically upward to engage the retractable dog 48 of the drive carrier trolley 28 to alter the movement of the carrier assembly 20. The power track and free track should be spaced from one another so that the pusher dogs of the power chain can pass underneath the free track without making contact. For the C-shaped channels and other conveyor tracks 34 designed with top track flanges disposed between the carrier trolleys 28 and transport surface 26 of the carrier, the top track flanges can be removed in sections of the conveyor track 34, as shown in FIG. 7, so the carrier assemblies 20 can be lifted from the conveyor track 34 for stacking. The bottom track flanges can also be removed in sections of the conveyor track 34 via a device to allow the retractable dog 48 to pass through the free track during lifting, but still be present for support during transport of the carrier assembly 20 into and out of the stacking station. As stated above, the track sections 30 of the carrier assemblies 20 used in PF conveyor systems can be elevated from the load surface 24 by a pedestal 52 so that the track sections 30 can engage the load carrier trolleys 28 and allow the drive carrier trolley 28 having the elongated carrier trolley stand 45 to rest on the load surface 24, as shown in FIG. 2.

The friction drive conveyor system can also be configured in a manner known in the art. As alluded to above, the conveyor track 34 can have an I-shaped cross-section for engaging the carrier trolleys 28 of a carrier assembly 20. The friction drive conveyor system includes a plurality of friction drive wheels positioned to engage the sides of the carrier assemblies 20 on the conveyor track 34. A pair of the friction drive wheels can be disposed in spaced locations along the conveyor track 34. A support wheel or idler can be disposed opposite each of the friction drive wheels for providing support to the carrier assembly 20 as it passes by the friction drive wheel. The friction drive wheels urge the carrier assembly 20 forward or backward along the conveyor track 34 at a predetermined speed. A drive control module including a power supply can be disposed adjacent each friction drive wheel. The friction drive wheels can be disposed so that at least one friction drive wheel engages the carrier assembly 20 traveling along the conveyor track 34 at all times. Like the PF conveyor track 34, the top track flanges of the conveyor track 34 can be removed in sections of the conveyor track 34 for lifting the carrier assemblies 20 from the conveyor track 34.

The overhead conveyor system can also be configured in a manner known in the art. Like the friction drive conveyor system, the conveyor track 34 of the overhead conveyor system can have an I-shaped cross-section for engaging the carrier trolleys 28 of a carrier assembly 20 and allowing the carrier assemblies 20 to travel along the conveyor track 34. The carrier trolleys 28 typically engage a bottom track flange of the I-shaped conveyor track 34 and the base member 22 hangs below the conveyor track 34, as shown in FIG. 6. The bottom track flanges of the conveyor track 34 can be removed in sections of the conveyor track 34 for allowing the carrier trolleys 30 to enter the conveyor track 34. As stated above, the track section 30 of the carrier assemblies 20 used in the overhead conveyor system can include an I-shaped load bar coupled to the load surface 24 by pedestals 52. The I-shaped load bar includes a lower flange having at least one opening allowing carrier trolleys 28 of another carrier assembly 20 to enter the track sections 30.

Each of the conveyor systems are designed to convey the carrier assemblies 20 through various track configurations of the manufacturing, storage, or other predetermined area. The conveyor systems can include a conveyor control module for controlling the operating parameters of the conveyor system.

The carrier stacking system 36 includes a lift means 70 for lifting and lowering the carrier assemblies 20 from the conveyor track 34 and for stacking the carrier assemblies 20 according to the method of the subject invention, which will be discussed further below. Typically, the lift means 70 can be disposed at a stacking station, located at the end of a production area after an unloading station 80, as shown in FIG. 16. The lift means 70 is capable of lifting one of the carrier assemblies 20 vertically and moving it horizontally so that it can be aligned and stacked on another on of the carrier assemblies 20. The lift means 70 is also capable of lifting a plurality of the stacked carrier assemblies 20 at the same time and disposing them on one or more other carrier assemblies 20.

The lift means 70 can include a lift device 72 supporting a telescoping arm 74 extending from the lift device 72 to one of the carrier assemblies 20 on the conveyor track 34, as shown in FIG. 17. The lift device 72 can be a scissor lift, as shown in FIG. 17, or another type of lifting device. The arm 74 is capable of telescoping in multiple directions. The arm 74 can include a hook 76 portion for engaging the transport surface 26 of the carrier assembly 20. The arm 74 can also include a pad 78, as shown in FIG. 17, extending downwardly from the arm 74 for aligning the lifted carrier assembly 20 in a predetermined position relative to another carrier assembly 20 on the conveyor track 34. The lift means 70 can include a lift control module 80 for controlling the lifting and lowering of the carrier assemblies 20. Although not shown, the lift means 70 can include a variety of other structures capable of lifting, lowering, and stacking the carrier assemblies 20. The carrier stacking system 36 can also include an un-stacking means 82 for un-stacking the carrier assemblies 20 and a loading station 83 for loading workpieces onto the carrier assemblies 20. The stacked carrier assemblies 20 can be transported from the manufacturing areas to storage areas, or un-stacked and used again in the conveyor system.

As alluded to above, after the workpiece or other materials are removed from the carrier assemblies 20, the method of the present invention can be used to stack the carrier assemblies 20. The method steps can vary depending on the design of the base member 22, carrier trolleys 28, and track sections 30 of the carrier assembly 20. For staking a plurality of the carrier assemblies 20 including track sections 30 having an open top, such as the open rectangular box or U-shaped channel, the method can include engaging the transport surface 26 of a first carrier assembly 20 with the hook 76 and then lifting the first carrier assembly 20 upwardly from the conveyor track 34 with the lift device 72, as shown in FIG. 17. Next, the method can including conveying a second carrier assembly 20 forward on the conveyor track 34 and aligning the track sections 30 directly under the carrier trolleys 28 of the lifted first carrier assembly 20. The method next includes lowering the first carrier assembly 20 until the carrier trolleys 28 of the first carrier assembly 20 engage the track sections 30 of the second carrier assembly 20. Alternatively, instead of conveying the second carrier assembly 20 forward on the conveyor track 34, the method can include moving the lifted first carrier assembly 20 horizontally toward the second carrier assembly 20 to align the carrier trolleys 28 of the first carrier assembly 20 vertically above the track sections 30 of the second carrier assembly 20. The second carrier assembly 20 can be engaged by the pad 78 of the arm 74 to assist in aligning the first carrier assembly 20 relative to the second carrier assembly 20.

The method can next include engaging the second carrier assembly 20 with the arm 74 and lifting the stacked first and second carrier assemblies 20 upwardly from the conveyor track 34, conveying a third carrier assembly 20 forward on the conveyor track 34, vertically aligning the track sections 30 of the third carrier assembly 20 with the carrier trolleys 28 of the second carrier assembly 20, and lowering the stacked first and second carrier assemblies 20 until the carrier trolleys 28 of the second carrier assembly 20 engage the track section 30 of the third carrier assembly 20. Alternatively, the method can include lifting the third carrier assembly 20 upwardly from the conveyor track 34, moving the lifted third carrier assembly 20 horizontally to align the carrier trolleys 28 of the third carrier assembly 20 with the track sections 30 of the first carrier assembly 20, and lowering the third carrier assembly 20 until the carrier trolleys 28 of the third carrier assembly 20 engage the track sections 30 of the first carrier.

For stacking a plurality of the carrier assemblies 20 including the track sections 30 having a T-shaped or I-shaped cross section, or C-shaped channels disposed on the load surface 24, the method can including lifting the first carrier assembly 20 and lowering the carrier trolleys 28 of the first carrier assembly 20 onto the load surface 24 of the second carrier assembly 20, adjacent the track sections 30, and then rolling the carrier trolleys 28 of the first carrier assembly 20 forward or backward to engage the track sections 30 of the second carrier assembly 20. If the T-shaped, I-shaped, or C-shaped track sections 30 are coupled to the load surface with pedestals 52, the method can include lowering the carrier trolleys adjacent the track sections 30, which is above the load surface 24, instead of onto the load surface 24.

For carrier assemblies 20 including the track sections 30 having open ends, such as the C-shaped channels, the method can include lifting the first carrier assembly 20 upwardly from the conveyor track 34 so that the carrier trolleys 28 of the first carrier assembly 20 are horizontally aligned with the track sections 30 of the second carrier assembly 20 disposed directly behind the lifted first carrier assembly 20. Next, the method includes conveying the second carrier assembly 20 forward on the conveyor track 34 until the carrier trolleys 28 of the first carrier assembly 20 engage the corresponding track sections 30 of the second carrier assembly 20. Alternatively, the arm 74 can move the lifted first carrier assembly 20 horizontally so that the carrier trolleys 28 of the first carrier assembly 20 roll continuously along the load surface 24 and into the track sections 30 of the second carrier assembly 20. Next, the method can include retracting the arm 74 from the first carrier assembly 20 to leave the first carrier assembly 20 and second carrier assembly 20 in the stacked position. As stated above, the method steps can be repeated for stacking any number of carrier assemblies 20.

For carrier assemblies 20 used in the overhead conveyor system and having the track section 30 including the I-shaped load bar, the method can first include lowering or removing the first carrier assembly 20 from the conveyor track 34. Next the method can include disposing the first carrier assembly 20 below a second carrier assembly 20, which is still engaging the conveyor track 34. The carrier trolleys 28 of the first carrier assembly 20 can be aligned with the openings of the track sections 30 of the second carrier assembly 20. The carrier trolleys 28 of the first carrier assembly 20 can either be inserted through the openings of the track section 30 of the second carrier assembly 20 or enter the track section 30 at open ends of the track section 30. Next, the first carrier assembly 20 can be shifted along the track section 30 of the second carrier assembly 20 until the wheels 58 of the carrier trolleys 28 of the first carrier assembly 20 are aligned above with the pockets 69 of the track section 30 of the second carrier assembly 20. The wheels 58 the first carrier assembly 20 can then be lowered into the pockets 69 of the second carrier assembly 20.

The method finally includes conveying the stacked carriers along the conveyor track 34 away from the stacking station. As stated above, the carrier trolleys 28 are able to pivot relative to the track sections 30 for conveying the stacked carrier assemblies 20 through various conveyor track 34 configurations, including vertical and horizontal curves.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A carrier stacking system comprising:

a plurality of carrier assemblies each presenting a load surface and a transport surface;

each of said carrier assemblies including a plurality of carrier trolleys extending transversely from said transport surface;

each of said carrier assemblies including a plurality of track sections coupled to said load surface for engaging said carrier trolleys of another one of said carriers;

a conveyor system for conveying said plurality of carrier assemblies through a predetermined area;

said conveyor system including a conveyor track for engaging said plurality of carrier assemblies; and a lift means for lifting one of said carrier assemblies from said conveyor track and lowering said carrier assembly onto another one of said carrier assemblies.

2. A system as set forth in claim 1 wherein at least one of said track sections includes a plurality of plates each extending upwardly from said load surface and together defining an open container.

3. A system as set forth in claim 1 wherein at least one of said track sections includes a pair of first plates each extending upwardly from said load surface in generally parallel relationship to one another to define a U-shaped channel.

4. A system as set forth in claim 3 wherein said at least one track section includes a second plate extending transverse to said generally parallel first plates and across said U-shaped channel.

5. A system as set forth in claim 1 wherein at least one of said track sections includes an I-shaped cross-section.

6. A carrier assembly system as set forth in claim 5 wherein said track section includes an I-shaped load bar coupled to said load surface by at least one pedestal.

7. A system as set forth in claim 6 wherein said I-shaped load bar includes a lower flange spaced from said pedestals and having at least one opening allowing carrier trolleys of another carrier to enter said track section.

8. A system as set forth in claim 1 wherein at least one of said track sections includes a T-shaped cross-section.

9. A system as set forth in claim 1 wherein at least one of said track sections includes a pair of gussets extending upwardly from said load surface and a perch interconnecting said gussets.

10. A system as set forth in claim 1 wherein at least one of said track sections includes a pair of C-shaped channels each having an upper flange and a lower flange projecting toward one another.

11. A system as set forth in claim 1 wherein at least one of said track sections are formed integral with said load surface.

12. A system as set forth in claim 1 including a plurality of pedestals each elevating one of said track sections above said load surface and coupling said track section to said load surface.

13. A system as set forth in claim 1 wherein one of said carrier trolleys includes a retractable dog.

14. A system as set forth in claim 1 including a rear cam for engaging a retractable dog of an adjacent carrier assembly.

15. A system as set forth in claim 1 including a securing means for securing said carrier assembly to another one of said carrier assemblies.

16. A system as set forth in claim 1 including a pivotal connection between each of said carrier trolleys and said transport surface for allowing rotational movement of said transport surface relative to said carrier trolleys.

17. A system as set forth in claim 1 each of said carrier assemblies includes a plurality of load bars.

18. A system as set forth in claim 1 wherein said track sections of said carrier assemblies are vertically aligned above said carrier trolleys of said carrier assemblies.

19. A system as set forth in claim 1 wherein said carrier assemblies include a retractable dog and a rear cam so that said rear cam of one of said carrier assemblies can engage a retractable dog of an adjacent carrier assembly.

20. A system as set forth in claim 1 wherein said conveyor track includes a power track and a free track for engaging said carrier trolleys of said carriers.

21. A system as set forth in claim 1 wherein said conveyor track includes an overhead conveyor track for engaging said carrier trolleys of said carrier assemblies.

22. A system as set forth in claim 1 wherein said conveyor system includes a plurality of drive wheels positioned to contact said carriers.

23. A system as set forth in claim 1 including a conveyor control module for controlling said conveyor system.

24. A system as set forth in claim 1 wherein said lift means includes a lift device and an arm supported by said lift device extending from said lift device to one of said carriers engaged by said conveyor track.

25. A system as set forth in claim 1 wherein said lift means includes a hook for engaging one of said carriers and a pad disposed adjacent said hook for engaging and aligning said carrier assemblies.

26. A system as set forth in claim 1 including an unstacking means for removing said carrier trolleys of one of said carrier assemblies from said track sections of another one of said carrier assemblies.

* * * * *